US008726522B2

(12) United States Patent
Lin

(10) Patent No.: US 8,726,522 B2
(45) Date of Patent: May 20, 2014

(54) PAIR OF SCISSORS WITH AN OPEN SECOND HANDLE

(71) Applicant: Nusharp Inc., Taichung (TW)

(72) Inventor: Chong-Jiang Lin, Taichung (TW)

(73) Assignee: Nusharp Inc., Taichung (TW)

( * ) Notice: Subject to any disclaimer, the term of this patent is extended or adjusted under 35 U.S.C. 154(b) by 7 days.

(21) Appl. No.: 13/717,288

(22) Filed: Dec. 17, 2012

(65) Prior Publication Data

US 2013/0097875 A1 Apr. 25, 2013

Related U.S. Application Data

(63) Continuation-in-part of application No. 12/897,676, filed on Oct. 4, 2010, now abandoned.

(51) Int. Cl.
*B26B 13/14* (2006.01)

(52) U.S. Cl.
USPC ..... 30/232; 30/298; 30/341

(58) Field of Classification Search
USPC ..... 30/232, 341, 298, 340, 342
See application file for complete search history.

(56) References Cited

U.S. PATENT DOCUMENTS

| | | | | | |
|---|---|---|---|---|---|
| 299,310 | A * | 5/1884 | Witte | 30/341 |
| 760,204 | A * | 5/1904 | Heinisch | 30/341 |
| 968,219 | A * | 8/1910 | Wheeler | 30/341 |
| 4,635,363 | A * | 1/1987 | Chapin | 30/257 |
| 5,778,540 | A * | 7/1998 | Huang | 30/232 |
| 6,249,977 | B1 * | 6/2001 | Knoop | 30/232 |
| 6,457,241 | B1 * | 10/2002 | Droin | 30/232 |
| 6,883,238 | B1 * | 4/2005 | Tran | 30/232 |
| D581,758 | S * | 12/2008 | Kolodsiejski | D8/57 |
| D590,677 | S * | 4/2009 | Pearson et al. | D8/57 |
| 2002/0129497 | A1 * | 9/2002 | Lyddon et al. | 30/232 |
| 2011/0047801 | A1 * | 3/2011 | Castley et al. | 30/232 |

* cited by examiner

*Primary Examiner* — Omar Flores Sanchez
(74) *Attorney, Agent, or Firm* — Banger Shia

(57) ABSTRACT

A pair of scissors with an open second handle includes a first blade and a second blade pivotally connected by a pivot member. A first grip portion of the first handle surrounds the basal portion of a user's thumb, the thumb extends out of an inserting hole of the first blade in a lateral direction and presses against a first extension section, so that the user can hold the first grip portion with the thumb without bending too much at the wrist, thus enhancing stability of holding the scissors. The user's middle, ring and little fingers press against the grip section of the second handle, and the index finger rests against the second extension section. Besides, since the second grip portion is an open structure, the fingers of the user are supported but not restricted by the second grip portion, which improves stability and flexibility when using the scissors.

4 Claims, 11 Drawing Sheets

PAIR OF SCISSORS WITH AN OPEN SECOND HANDLE

This application is a continuation in part of U.S. patent application Ser. No. 12/897,676, and claims 1-5 of this application are new.

BACKGROUND OF THE INVENTION

1. Field of the Invention

The present invention relates to a pair of scissors, and more particularly to a pair of scissors with an open second handle.

2. Description of the Prior Art

A first pair of conventional scissors 10, as shown in FIGS. 1-2, comprises two blades 11, 12 that are pivotally connected at a pivot, and two handles 13, 14 that are connected to the respective blades 11, 12 adjacent to the pivot of the two blades 11, 12. The respective handles 13, 14 are provided with a ring-shaped grip portion 15, 16. The first grip portion 15 is provided for insertion of the thumb 21 of a user's hand 20 to push the first blade 11 to rotate, while other fingers of the hand 20 insert in the second grip portion 16 to rotate the second blade 12 through the second handle 14.

The thumb 21 of the hand 20 includes, from a base joint 211 of a base 210 of the thumb 21, a first segment bone 212, a first joint 213 and a second segment bone 214. When the tip end of the thumb 21 inserts in the first grip portion 15, the first grip portion 15 will be located on the second segment bone 214, and the closing and opening of the scissors 30 are normally achieved by the relative motion of the thumb 21 and other four fingers around the base joint 211 of the thumb 21. In order to make the two blades 11, 12 of the scissors 10 move away from each other from the closed position to carry out an opening operation, the thumb 21 should gradually move away from other four fingers, however, when using scissors, most users' habit is to move the thumb 21 and other four fingers without moving the wrist. Just as shown in FIG. 2, the first segment bone 212 of the thumb 21 moves an angle $\alpha$ around the base joint 211 from its original position, causing the scissors 10 to deflect a deflection angle $\beta$ from its original vertical position, meanwhile, the second segment bone 214 is caused to deflect a deflection angle $\sigma$ around the first joint 213, so that the total deflection angle of the scissors 10 is the sum of the deflection angles $\beta$ and $\sigma$, thus causing the undesired movement of the blades 11, 12 during the cutting operation. As a result, it can be found that the cutting quality is difficult to control due to the undesired movement of the scissors, which is likely to further endanger the other hand holding the object to be cut.

Furthermore, referring to FIG. 3 which illustrates a second pair of conventional scissors, the grip portions 15, 16 are designed to abut more closely against the palm. The grip portion 15 is formed with a tapered through hole to better fit the thumb 21. However, the grip portion 15 is still located on the second segment bone 214, so the drawback of undesired movement of the scissors shown in FIG. 2 still exists.

Since the respective grip portions 15 of the above scissors 10 are engaged on the second segment bone 214 of the thumb 21, the undesired movement is likely to occur during the operation of the scissors 10. In addition, since the grip portions 15, 16, the handles 13, 14 and the blades 11, 12 are located on the same plane, it is difficult for the user to directly insert the thumb and other four fingers of one hand in the grip portions 15, 16 when the scissors 10 is placed on a table and the user needs to pick it up, so the user has to pick the scissors 10 up from the table with one hand and then the other hand is able to insert in the grip portions 15, 16, leading to inconvenience in use.

FIG. 4 shows another type of conventional scissors 30 which comprise a first handle 31 and a second handle 32 pivotally connected by a pivot 33. An axial direction of the pivot 33 is defined as a positive direction F1, and a direction perpendicular to the positive direction F1 is defined as a lateral direction F2. The first handle 31 includes a ring-shaped first grip portion 311, and the second handle 32 includes a ring-shaped second grip portion 321. The user has to insert fingers into the first and second grip portions 311, 321, so that the enclosed structure of the first and second grip portions 311, 321 will affect the movement of the hand gripping the scissors 30.

In addition, when using the scissors 10, 30, the user has to insert the thumb into the first grip portion 311 in such a manner that the thumb extends in the positive direction F1, and the first grip portion 311 is in line with the blades. To hold the scissors tight, the user's thumb has to fold when gripping the first grip portion 311, which not only makes the user feel uncomfortable but also makes it difficult to perform precise straight line cut. Furthermore, the first grip portion 311 is in line with the blades, the user has to bend his wrist over in order to keep the blades moving straight forward, which might cause discomfort and even pain to the wrist.

The present invention has arisen to mitigate and/or obviate the afore-described disadvantages.

SUMMARY OF THE INVENTION

The primary objective of the present invention is to provide a pair of scissors with an open second handle which comprises:

a first blade and a second blade pivotally connected by a pivot member, the first blade being provided with a first cutting portion and a first handle at both ends thereof, and the second blade being provided with a second cutting portion and the open second handle at both ends thereof, the pivot member being inserted through the first and second handles, an axial direction of the pivot member being defined as a positive direction, and a direction perpendicular to the positive direction being defined as a lateral direction. The pair of scissor is characterized in that:

The first and second blades extend along a longitudinal axis;

the first handle includes a first extension section connected to the first cutting portion and a first grip portion, when viewing from the lateral direction, the first extension section extends along the longitudinal axis, when viewing from the positive direction, the first extension section extends along a first extension axis which defines a first angle with respect to the longitudinal axis, the first angle is 35-75 degrees, the first grip portion includes a first forked portion, an engaging portion, an abutting portion and a connecting portion, the first forked portion includes a concave arc-shaped surface, one end of the first forked portion is tapered inward and connected to one end of the engaging portion, and another end of the first forked portion opens outward and is connected to one end of the abutting portion, another ends of the engaging portion and the abutting portion are connected by the connecting portion, so as to form an enclosed ring structure which defines an inserting hole, the abutting portion has a width which is 1.5-5.5 times a width of the engaging portion, when viewing from the lateral direction, the engaging portion extends along a second extension axis which defines a second angle with respect to the longitudinal axis, and the second angle is 12-52 degrees;

the second handle includes a second extension section connected to the second cutting portion and a second grip portion, the second extension section extends along the longitudinal axis. The second grip portion includes a second forked portion with one end connected to one end of a grip section and with another end connected to one end of a push portion, and another end of the grip section is separated from another end of the push portion, the grip section has a length larger than a length of the push portion.

The first grip portion of the first handle surrounds the basal portion of the user's thumb to enable the thumb to extend out of the inserting hole in the lateral direction and to press against the first extension section, so that the user can hold the first grip portion with the thumb without bending too much at the wrist, so as to enhance stability of holding the scissors. The user's middle finger, ring finger and little finger press against the grip section of the second handle, and the index finger rests against the second extension section to enhance the stability of holding the scissors. In addition, since the second grip portion is an open structure instead of an enclosed ring structure, the fingers of the user are supported but not restricted by the second grip portion, which improves stability and flexibility when using the scissors.

DETAILED DESCRIPTION OF THE PREFERRED EMBODIMENTS

Figure 1:
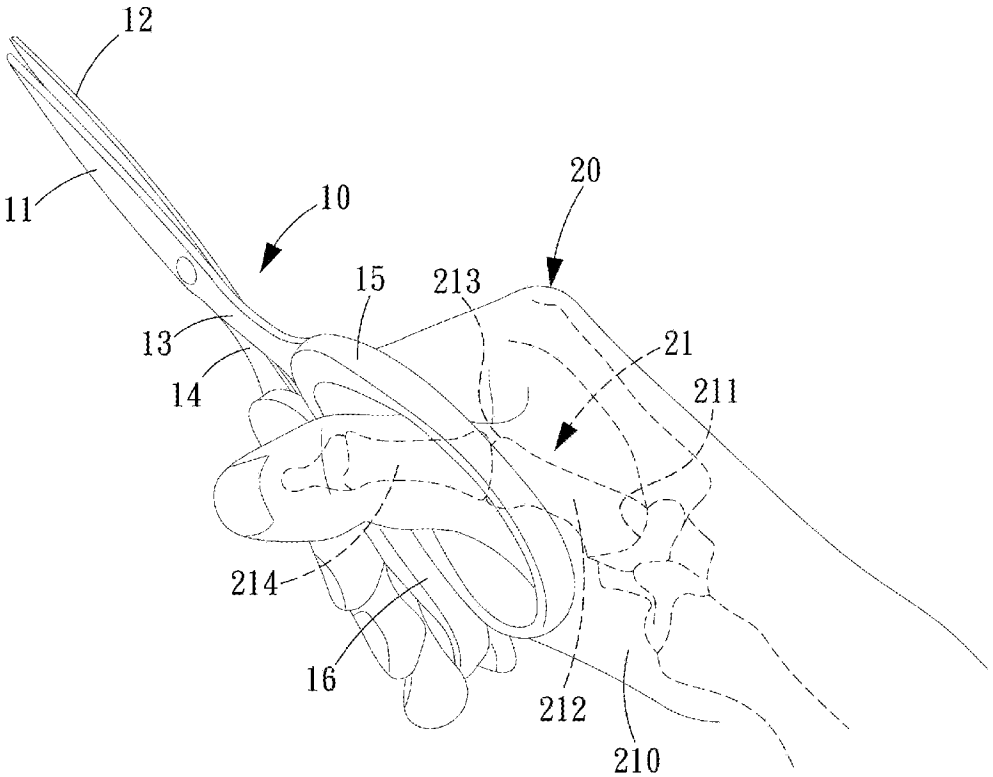
FIG. 1 PRIOR ART
FIG. 1 is a schematic view of a first pair of conventional scissors gripped by the hand.
Figure 2:
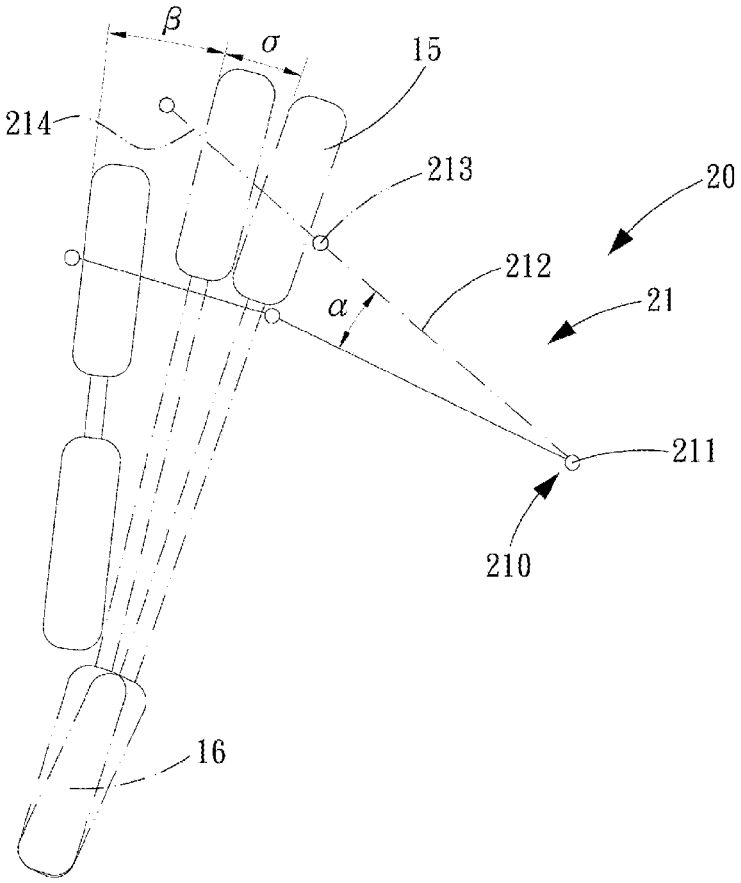
FIG. 2 PRIOR ART
FIG. 2 is a skeleton view of the thumb of the hand gripping the scissors of FIG. 1.
Figure 3:
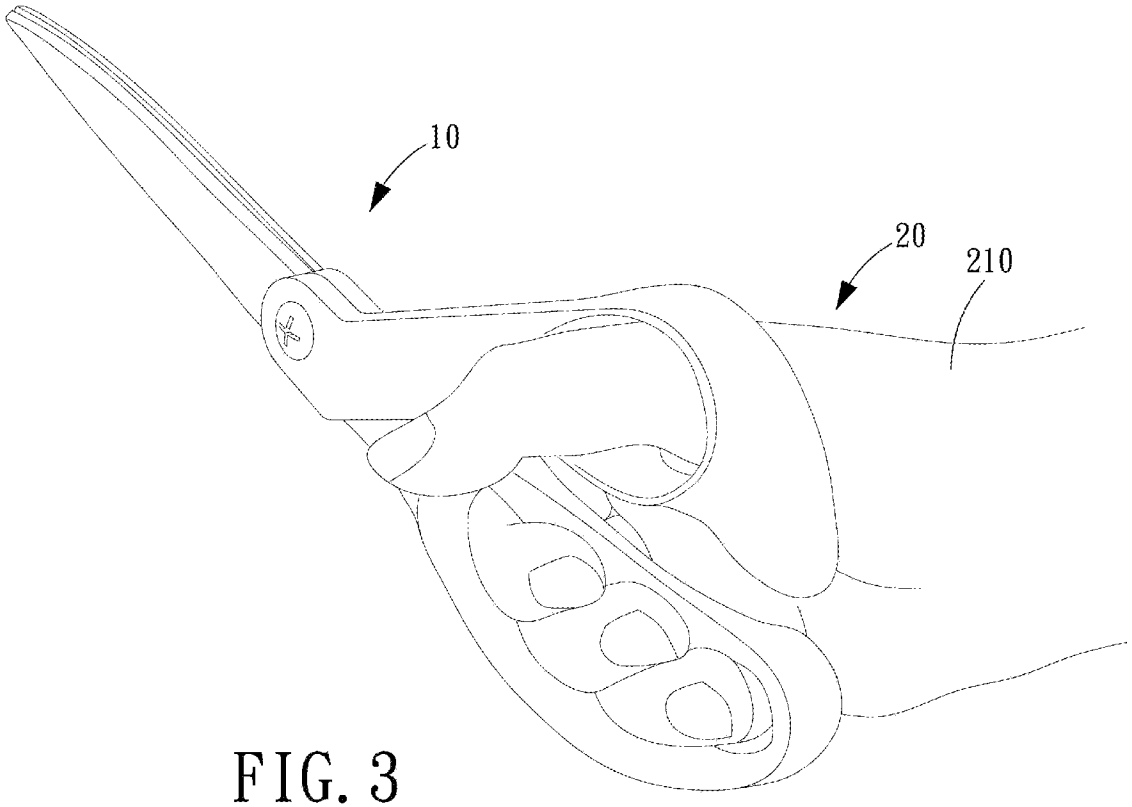
FIG. 3 PRIOR ART
FIG. 3 is a schematic view of a second pair of conventional scissors gripped by the hand.
Figure 4:
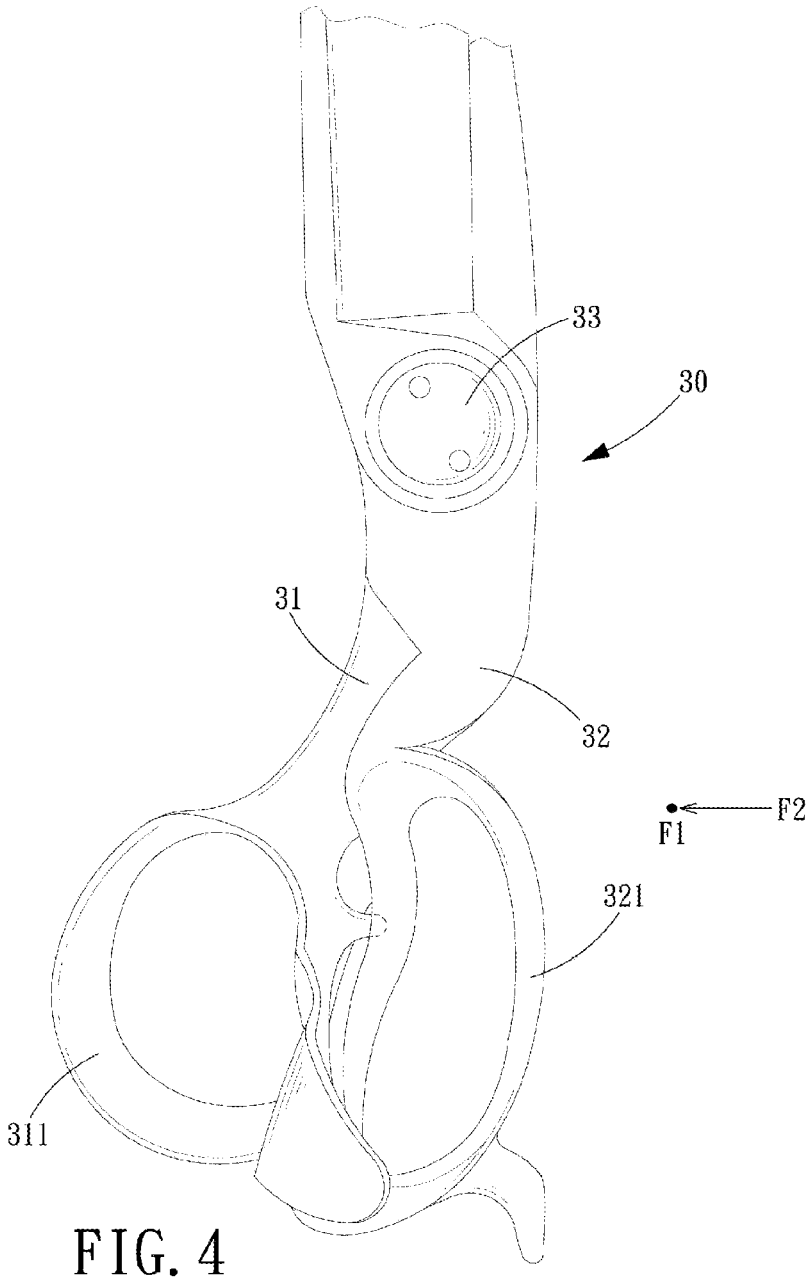
FIG. 4 PRIOR ART
FIG. 4 shows another type of conventional scissors.
Figure 5:
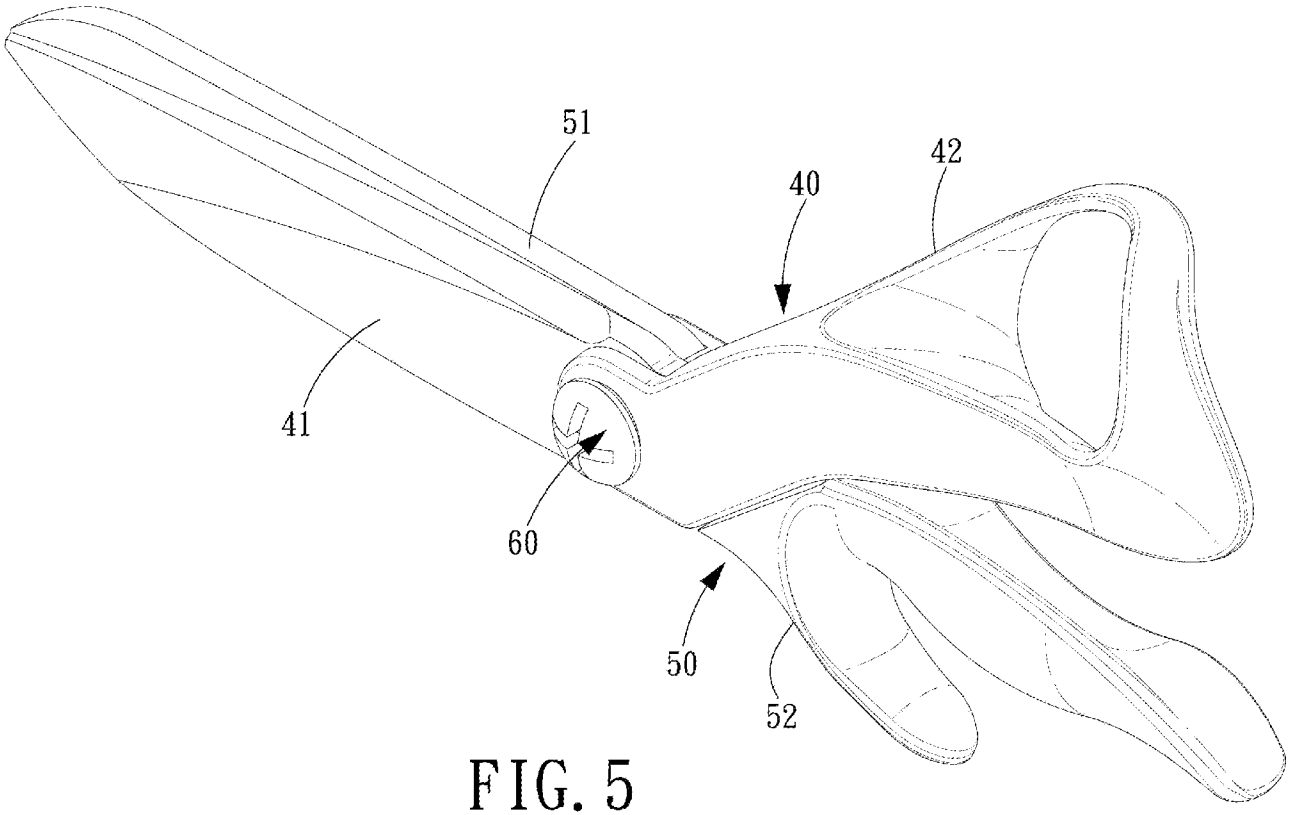
FIG. 5 is a perspective view of a the pair of scissors with an open second handle in accordance with the present invention.
Figure 6:
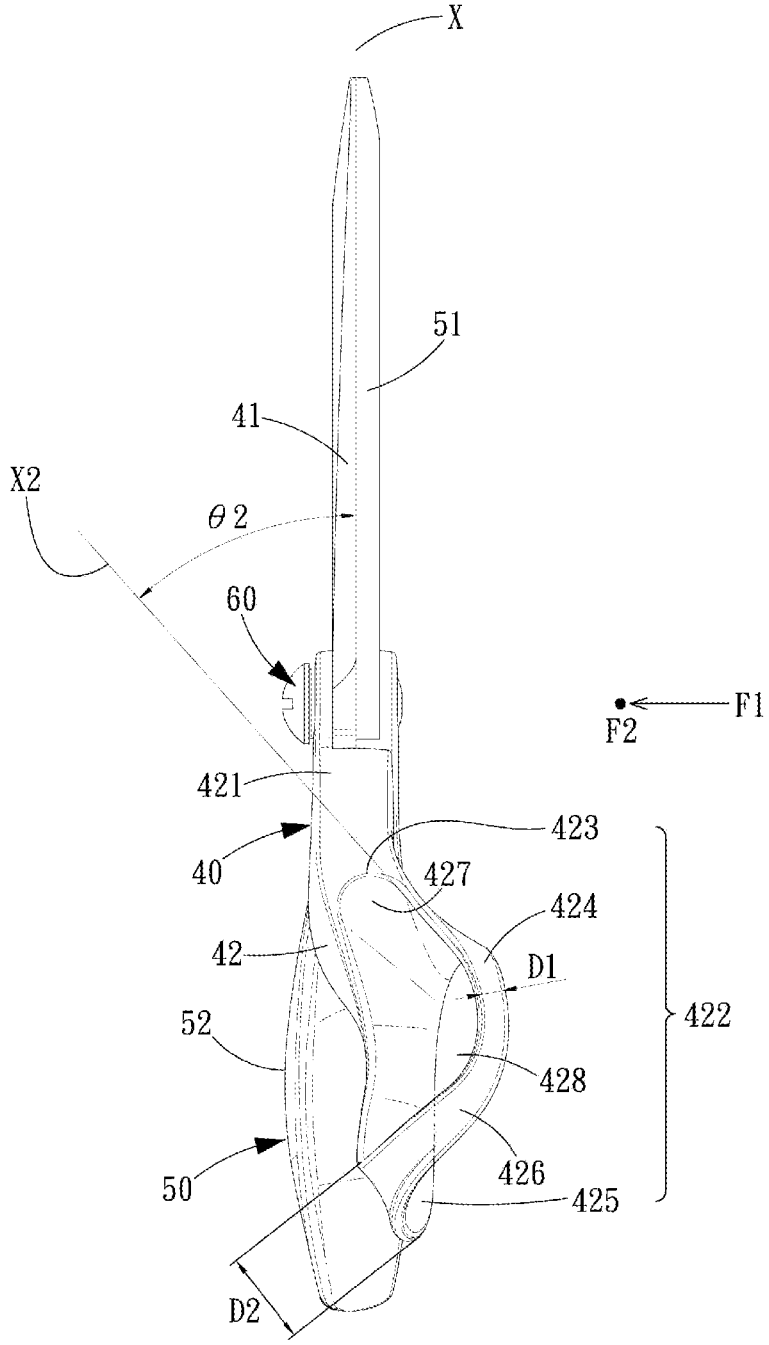
FIG. 6 is a side view of the pair of scissors with an open second handle in accordance with the present invention.
Figure 7:
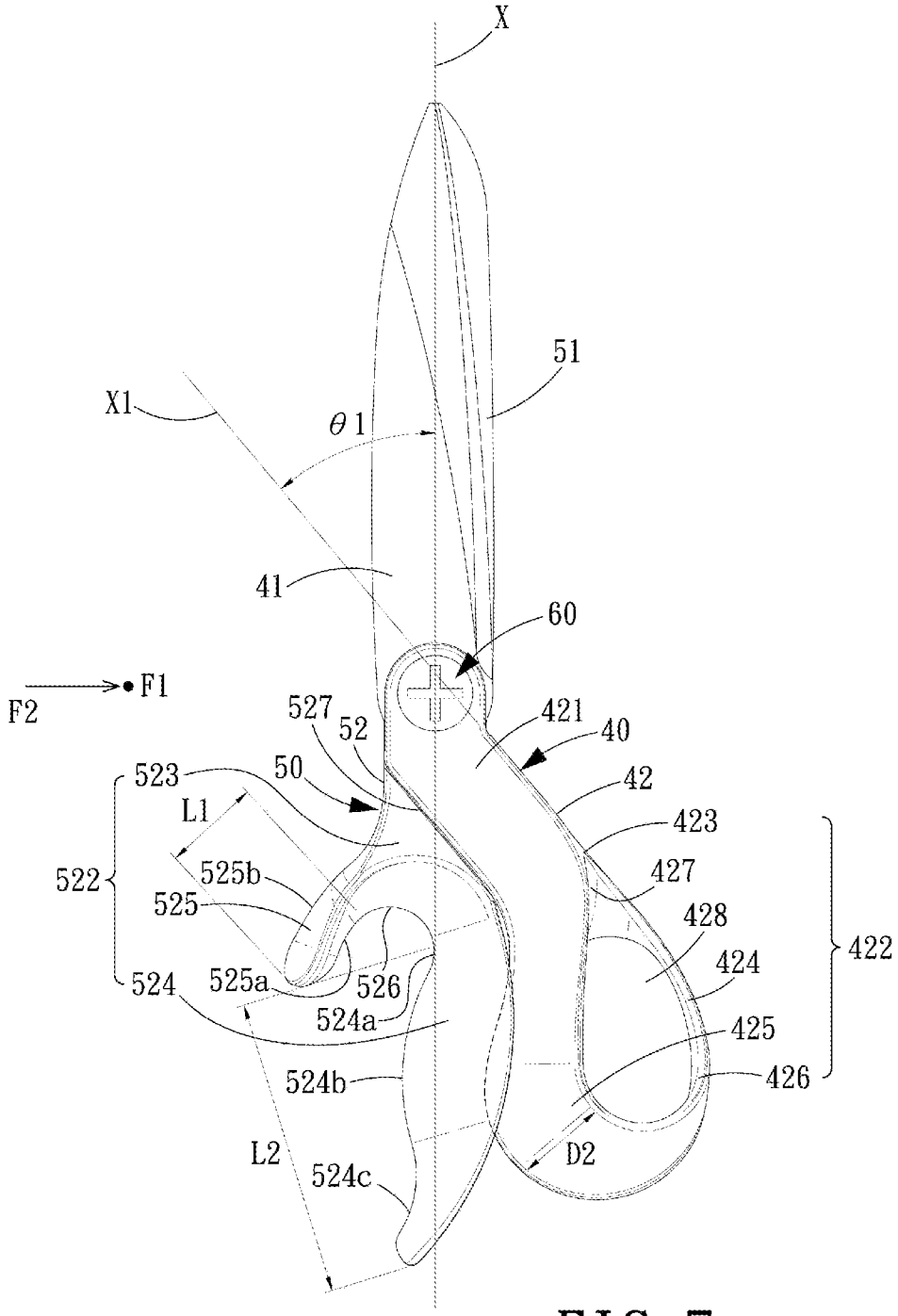
FIG. 7 is a plan view of the pair of scissors with an open second handle in accordance with the present invention.
Figure 8:
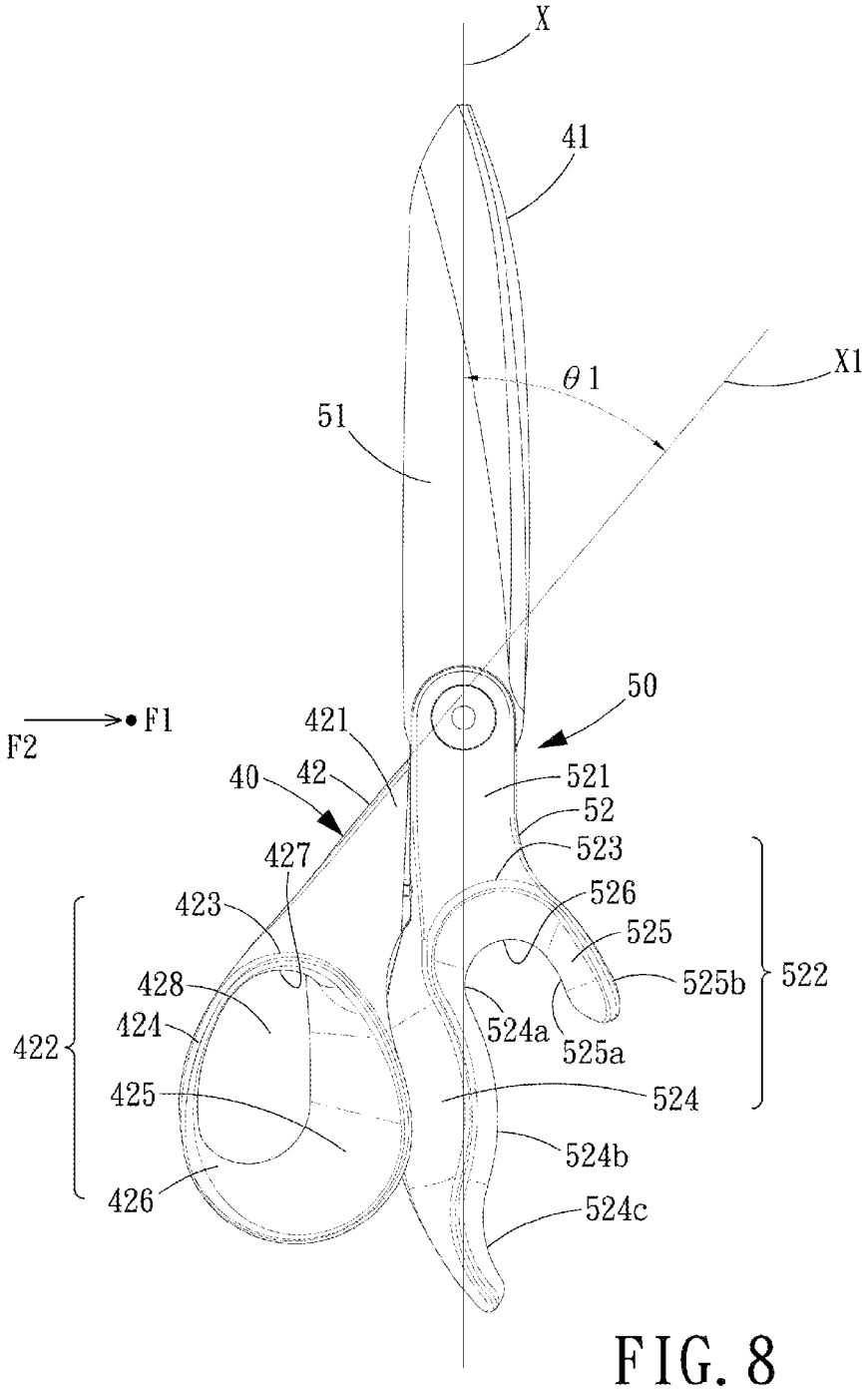
FIG. 8 is another plan view of the pair of scissors with an open second handle in accordance with the present invention.

The present invention will be clearer from the following description when viewed together with the accompanying drawings, which show, for purpose of illustrations only, the preferred embodiment in accordance with the present invention.

Referring to FIGS. 5-8, a pair of scissors with an open second handle in accordance with the present invention comprises a first blade 40 and a second blade 50 which are pivotally connected by a pivot member 60. The first blade 40 is provided with a first cutting portion 41 and a first handle 42 at both ends thereof, and the second blade 50 is provided with a second cutting portion 51 and a second handle 52 at both ends thereof. The pivot member 60 is inserted through the first and second handles 42, 52, an axial direction of the pivot member 60 is defined as a positive direction F1, and a direction perpendicular to the positive direction F1 is defined as a lateral direction F2.

The first and second blades 40, 50 extend along a longitudinal axis X.

The first handle 42 includes a first extension section 421 connected to the first cutting portion 41 and a first grip portion 422. When viewing from the lateral direction F2, the first extension section 421 extends along the longitudinal axis X, when viewing from the positive direction F1, the first extension section 421 extends along a first extension axis X1 which defines a first angle θ1 with respect to the longitudinal axis X. The first angle θ1 is 35-75 degrees. The first grip portion 422 includes a first forked portion 423, an engaging portion 424, an abutting portion 425 and a connecting portion 426. The first forked portion 423 includes a concave arc-shaped surface 427, one end of the first forked portion 423 is tapered inward and connected to one end of the engaging portion 424, and another end of the first forked portion 423 opens outward and is connected to one end of the abutting portion 425. Another ends of the engaging portion 424 and the abutting portion 425 are connected by the connecting portion 426, so as to form an enclosed ring-shaped structure. Namely, the first forked portion 423, the engaging portion 424, the abutting portion 425 and the connecting portion 426 are connected to an enclosed ring-shaped structure which defines an inserting hole 428. The abutting portion 425 has a width D2 which is 1.5-5.5 times a width D1 of the engaging portion 424. When viewing from the lateral direction F2, the engaging portion 424 extends along a second extension axis X2 which defines a second angle θ2 with respect to the longitudinal axis X1, and the second angle θ2 is 12-52 degrees, and preferably 28 degrees, so that the first grip portion 422 is a little deviated from the longitudinal axis X, the inserting hole 428 tapers downward along the second extension axis X2, and the configuration of the inserting hole 428 is such that the diameter of the part of the inserting hole 428 which is located close to the longitudinal axis X is larger than the diameter of the part of the inserting hole 428 which is located further away from the longitudinal axis X (the closer the part of the inserting hole 428 is to the longitudinal axis X, the larger the diameter of the part of the inserting hole 428 will be).

The second handle 52 includes a second extension section 521 connected to the second cutting portion 51 and a second grip portion 522. The second extension section 521 extends along the longitudinal axis X. The second grip portion 522 includes a second forked portion 523 with one end connected to one end of a grip section 524 and with another end connected to one end of a push portion 525, and another end of the grip section 524 is separated from another end of the push portion 525. The grip section 524 has a length L1 larger than a length L2 of the push portion 525. The second forked portion 523 includes a concave arc-shaped surface 526 and a connecting surface 527, and the grip section 524 and the push portion 525 are located at both ends of the concave arc-shaped surface 526. The connecting surface 527 is able to lean against the first extension section 421 of the first handle 42 in a parallel manner. The grip section 524 is adjacent to the first handle 42. A surface of the grip section 524 facing the push portion 525 is a curved surface which consists of a concave arc-shaped section 524*a*, a convex section 524*b* and an arc-shaped end 524*c*. A surface of the push portion 525 facing the grip section 524 is an inner surface 525*a*, another surface of the push portion 525 is an outer surface 525*b* which is an arc-shaped surface.

Figure 9:
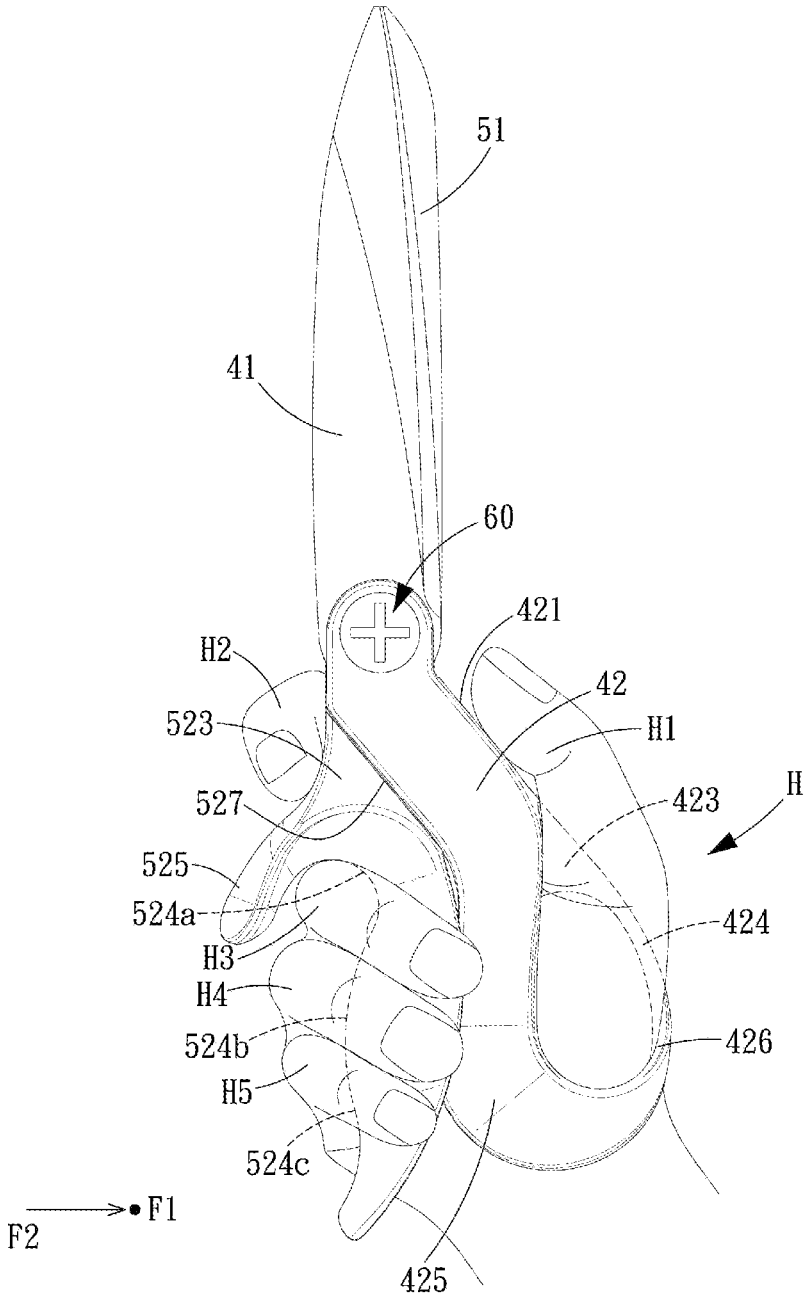
FIG. 9 is a schematic view showing the hand gripping the scissors in accordance with the present invention.
Figure 10:
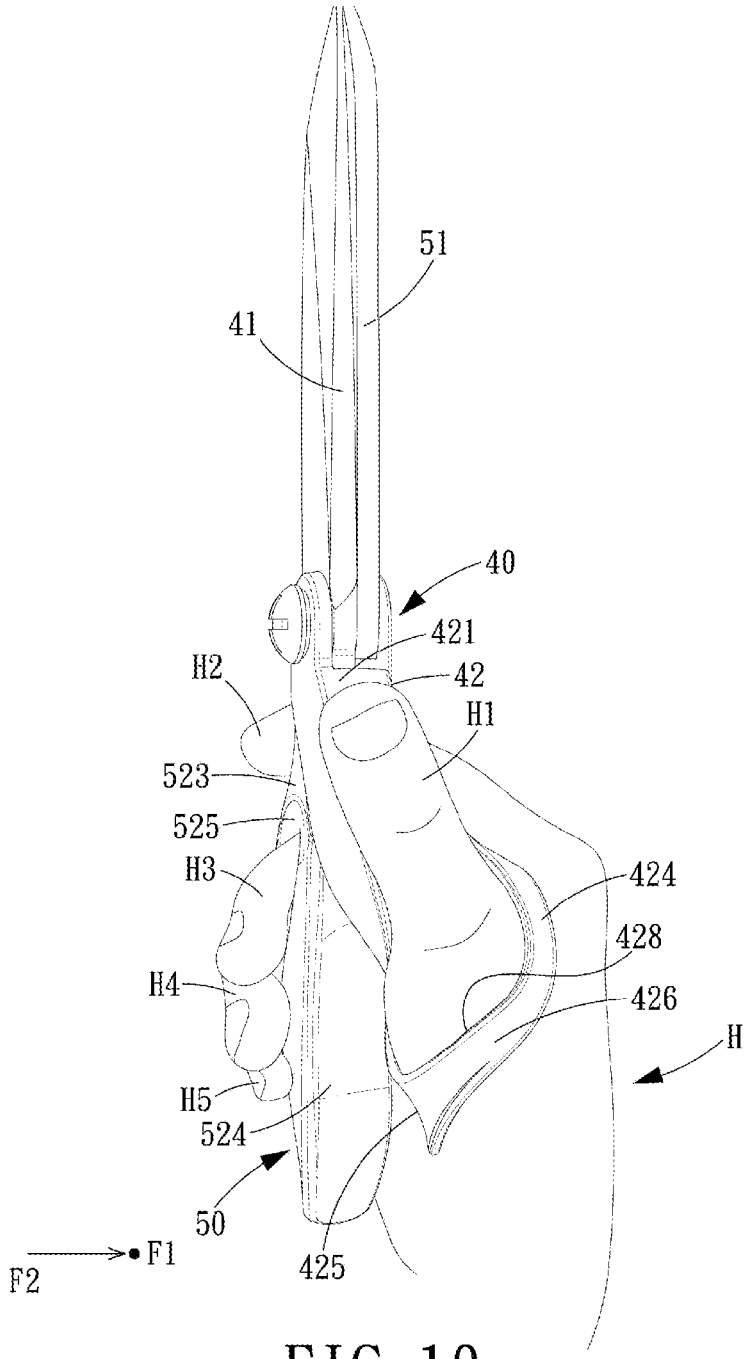
FIG. 10 is another schematic view showing the hand gripping the scissors in accordance with the present invention.

Referring then to FIGS. 9 and 10, when a user holds the pair of scissors of the present invention with one hand H, the thumb H1 of his/her hand H is inserted in the inserting hole 428 of the first grip portion 422 of the first handle 42 of the first blade 40, so that the basal portion of the thumb H1 can be pressed against the large abutting portion 425, and the engaging portion 424 and the connecting portion 426 surround the thumb H1. Meanwhile, the thumb H1 rests against the concave arc-shaped surface 427 of the first forked portion 423 and extends in the lateral direction F2 until it presses against the first extension section 421. By such arrangements, the first grip portion 422 of the first blade 40 employs the large abutting portion 425 to support the basal portion of the thumb H1 with large area, so that the engaging portion 424 and the connecting portion 426 are capable of authentically surrounding and covering the basal portion of the thumb H1. Besides, the thumb H1 extends out of the inserting hole 428 along the lateral direction F2 instead of along the positive direction F1, therefore, the user's thumb H1 can rest against the first handle 42 easily and comfortably without bending too much at the wrist, namely, the scissors of the present invention can be hold easily and comfortably, and cutting operation with the scissors would also be easier and more stable.

The user's index finger H2 rests against a surface (opposite the connecting surface 527) of the second forked portion 523 of the second handle 52. The middle finger H3, the ring finger H4 and the little finger H5 of the user grip the grip section 524 in such a manner that the middle finger H3 rests against the concave arc-shaped section 524*a* and the concave arc-shaped surface 526, the ring finger H4 rests against the convex section 524*b*, and the little finger H5 can rest against the arc-shaped end 524*c*, enhancing the stability of holding the scissors. In addition, since the second grip portion 522 is an open structure instead of an enclosed ring structure, the fingers of the user are supported but not restricted by the second grip portion 522, which improves stability and flexibility when using the scissors.

The pair of scissors with an open handle in accordance with the present invention has the following advantages:

1. High stability: the first grip portion 422 employs the large abutting portion 425 to support the basal portion of the thumb H1 with large area, so that the engaging portion 424 and the connecting portion 426 are capable of authentically surrounding and covering the basal portion of the thumb H1, so that as long as the hand H keeps stable, the first cutting portion 41 connected to the first grip portion 422 will perform the cutting operation with high stability.

2. Better cutting direction control and high safety: since the base of the thumb H1 is fully inserted in the first grip portion 422, the cutting stability is high without undesired deflection, the tip ends of the two blades 40, 50 are effectively controlled in direction, avoiding endangering the other hand holding the object to be cut, enhancing the safety of the scissors.

3. Substantially enhanced cutting quality: due to the high stability and controllability between the first grip portion 422 and the hand H, the occurrence of undesired deflection and swing is reduced, and when being cutting the object, the two blades 40, 50 can be maintained in the optimal vertical direction, realizing the best cutting quality.

Figure 11:
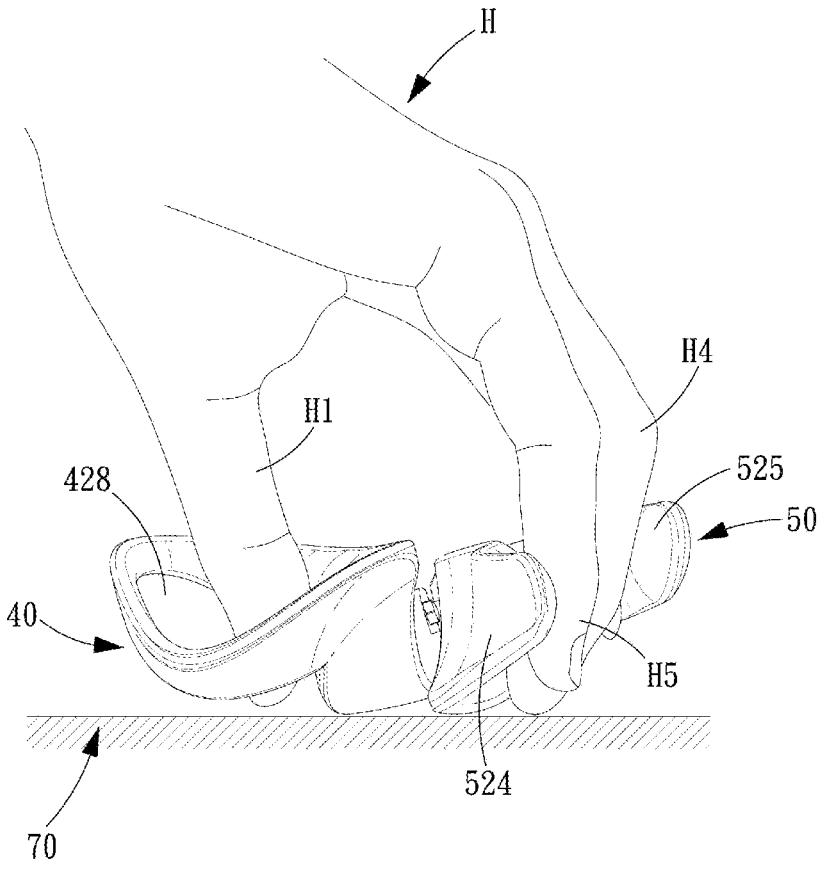
FIG. 11 is a schematic view showing how the user picks up the scissors in accordance with the present invention with one hand.

4. Convenient to pick up: when viewing from the lateral direction F2, the engaging portion 424 extends along the second extension axis X2 which defines a second angle θ2 with respect to the longitudinal axis X1, which makes the first grip portion 422 oblique with respect to the first handle 42, so that when the scissors are placed on the desk, the first grip portion 422 is kept away from the desk, as shown in FIG. 11, for facilitating the insertion of the finger of the user without the help of the other hand, thus improving the convenience in use.

While we have shown and described various embodiments in accordance with the present invention, it is clear to those skilled in the art that further embodiments may be made without departing from the scope of the present invention.

What is claimed is:

1. A pair of scissors with an open second handle comprising:

a first blade and a second blade pivotally connected by a pivot member, the first blade being provided with a first cutting portion and a first handle at both ends thereof, and the second blade being provided with a second cutting portion and the open second handle at both ends thereof, the pivot member being inserted through the first and second handles, an axial direction of the pivot member being defined as a positive direction, and a direction perpendicular to the positive direction being defined as a lateral direction; characterized in that:

the first and second blades extend along a longitudinal axis;

the first handle includes a first extension section connected to the first cutting portion and a first grip portion, when viewing from the lateral direction, the first extension section extends along the longitudinal axis, when viewing from the positive direction, the first extension section extends along a first extension axis which defines a first angle with respect to the longitudinal axis, the first angle is 35-75 degrees, the first grip portion includes a first forked portion, an engaging portion, an abutting portion and a connecting portion, the first forked portion includes a concave arc-shaped surface, one end of the first forked portion is tapered inward and connected to one end of the engaging portion, and another end of the first forked portion opens outward and is connected to one end of the abutting portion, another ends of the engaging portion and the abutting portion are connected by the connecting portion, so as to form an enclosed ring structure which defines an inserting hole, the abutting portion has a width which is 1.5-5.5 times a width of the engaging portion, when viewing from the lateral direction, the engaging portion extends along a second extension axis which defines a second angle with respect to the longitudinal axis, and the second angle is 12-52 degrees;

the second handle includes a second extension section connected to the second cutting portion and a second grip portion, the second extension section extends along the longitudinal axis, the second grip portion includes a second forked portion with one end connected to one end of a grip section and with another end connected to one end of a push portion, and another end of the grip section is separated from another end of the push portion, the grip section has a length larger than a length of the push portion;

a surface of the grip section facing the push portion is a curved surface which consists of a concave arc-shaped section, a convex section and an arc-shaped end, a surface of the push portion facing the grip section is an inner surface, and another surface of the push portion is an outer surface which is an arc-shaped surface.

2. The pair of scissors with the open second handle as claimed in claim 1, wherein the second forked portion includes a concave arc-shaped surface, the grip section and the push portion are located at both ends of the concave arc-shaped surface, and the grip section is adjacent to the first handle.

3. The pair of scissors with the open second handle as claimed in claim 1, wherein the second forked portion includes a connecting surface which is able to lean against the first extension section of the first handle in a parallel manner.

4. The pair of scissors with the open second handle as claimed in claim 1, wherein the second angle is 28 degrees.

* * * * *